US006247744B1

(12) United States Patent
Townsend et al.

(10) Patent No.: US 6,247,744 B1
(45) Date of Patent: Jun. 19, 2001

(54) STRUCTURALLY INTEGRATING MEMBERS BETWEEN VEHICLE BODIES AND CLOSURES

(75) Inventors: John A. Townsend; Mohamed El-Sayed, both of Bloomfield Hills, MI (US)

(73) Assignee: Joalto Design, Inc., Southfield, MI (US)

( * ) Notice: Subject to any disclaimer, the term of this patent is extended or adjusted under 35 U.S.C. 154(b) by 0 days.

(21) Appl. No.: 09/169,330

(22) Filed: Oct. 9, 1998

(51) Int. Cl.[7] ..... B60J 5/00
(52) U.S. Cl. ..... 296/146.11; 296/202; 16/388
(58) Field of Search ..... 296/146.11, 202; 16/362–364, 388

(56) References Cited

U.S. PATENT DOCUMENTS

| | | | | |
|---|---|---|---|---|
| 905,201 | * | 12/1908 | Magnusen | 16/388 |
| 1,257,572 | * | 2/1918 | Appleby | 16/388 X |
| 1,612,656 | * | 12/1926 | Salin | 16/368 X |
| 2,144,863 | * | 1/1939 | Webber | 296/146.11 X |
| 2,167,585 | * | 7/1939 | Mulvaney | 16/364 |
| 2,211,581 | * | 8/1940 | Ross | 16/364 |
| 3,819,228 | | 6/1974 | Cornacchia . | |
| 4,131,969 | * | 1/1979 | Suska | 16/388 |
| 4,133,114 | * | 1/1979 | Roach | 16/388 X |
| 4,881,298 | * | 11/1989 | Turnbull | 296/146.11 X |
| 5,378,036 | | 1/1995 | Townsend . | |
| 5,806,917 | * | 9/1998 | Townsend | 296/146.11 X |

FOREIGN PATENT DOCUMENTS

| | | | | |
|---|---|---|---|---|
| 18 06 716 | | 6/1970 | (DE) . | |
| 323908 | * | 11/1970 | (DK) | 16/388 |
| 2 739 596 | | 4/1997 | (FR) . | |
| 1 444 790 | | 8/1976 | (GB) . | |
| 2 312 914 | | 11/1997 | (GB) . | |

* cited by examiner

*Primary Examiner*—Dennis H. Pedder
(74) *Attorney, Agent, or Firm*—Rader, Fishman & Grauer PLLC

(57) ABSTRACT

A vehicle component sub-assembly having self-aligning appropriately fitted structural members is disclosed wherein a closure member, such as a vehicle door, hood or trunk is integrated with and becomes a structural part of a vehicle body. The sub-assembly includes mating components wherein a first mating component is mounted to the vehicle body and a second mating component is mounted to the closure member in such a manner that the first and second mating components become substantially aligned and structurally engaged with one another. The first mating component includes at least one structural key member formed thereon and the second mating component has a complementary mating receptacle therein. When the first and second mating components are aligned into interlocking engagement, the structural key members and mating receptacles are thereby structurally integrating the vehicle body and the closure member. The structural key members and mating receptacles may be used with a number of vehicle component sub-assemblies such as door hinges and latches on doors; hoods, trunks, liftgates and deck lids.

2 Claims, 16 Drawing Sheets

Flg. 14

STRUCTURALLY INTEGRATING MEMBERS BETWEEN VEHICLE BODIES AND CLOSURES

FIELD OF THE INVENTION

The present invention relates to structurally integrating members between vehicle bodies and closures. More particularly, this invention is directed to self-aligning structural key members and mating receptacles incorporated with vehicle component sub-assemblies, such as hinges and latches, to structurally integrate vehicle closures with a vehicle body.

BACKGROUND OF THE INVENTION

While known conventional vehicle closure members, such as vehicle doors, are attached to a vehicle body, the closure members are not structurally integrated with the vehicle body. Consequently, the closure members, which are of considerable mass, are simply hanging on the vehicle body. Thus, stiffness and overall strength of the vehicle body is reduced, which results in a noticeable feeling to a vehicle occupant of shuddering and bouncy ride. Idle shake may also be experienced, along with an increase in noise and vibration, producing a poor ride and poor vehicle handling. Further, in the event of impact or collision with other vehicles, a non-integrated closure member can "pop out" from the vehicle body, or cave in, such that the closure member is separated from its attachment points. Separation of the closure member from the vehicle body causes loss of a significant amount of energy absorption that is necessary to protect the vehicle occupants from injury during a collision.

To address these problems, it has been previously proposed to structurally integrate a vehicle door with a vehicle body. The door and body integration technology as applied to vertically sliding doors is disclosed in the following U.S. Patents issued to John A. Townsend: U.S. Pat. No. 4,801,172 issued Jan. 31, 1989; U.S. Pat. No. 4,940,282 issued Jul. 10, 1990; U.S. Pat. No. 5,378,036 issued Jan. 3, 1995; and applied to a conventional hinged door in U.S. Pat. No. 5,806,917 issued Sep. 15, 1998. These disclosures are incorporated herein by reference.

In operation, when the vehicle doors of the above patents are closed, structural key members formed on the edges of the door engage with mating receptacles formed in the door jambs of the vehicle body that frame a door opening. In the engaged position, each key member and mating receptacle pair is able to transmit compressive, tensile and torsional forces between the door and the vehicle body, thereby contributing to the overall stiffness of the vehicle body.

However, with current technology precise manufacturing dimensional tolerances of a large closure member, such as the vehicle door, that incorporate the structural keys and receptacles are difficult to achieve such that when the vehicle door is aligned with the vehicle body by adjusting hinges and latches on the vehicle door and vehicle body, the keys and receptacles are not always properly aligned for mating engagement. To insure proper alignment of the keys and receptacles, it has been proposed to form the receptacles so as to be considerably larger than the keys. With such an arrangement, the keys could be loosely accommodated within the receptacles once the closure member had been adjusted into its correct position with respect to the vehicle body by means of the hinge and latch assemblies. Fast curing metallic epoxy resin was then applied to the inside of the receptacles and a resist compound to the keys. The closure member was then closed in its final adjustment position with reference to the vehicle body. After curing, the keys were mated precisely with the key impressions made in the resin within the receptacles. Once the keys and receptacles were properly aligned, the keys and receptacles provided an excellent structural link between the closure member and the vehicle body, due to the precise fit of the keys with the epoxy filled receptacle.

However, the addition of the epoxy resin to the receptacles required an additional alignment process on the production line, thereby disadvantageously increasing manufacturing time, which translates into increased costs. Further, as it is necessary to add the epoxy resin to the receptacles on the production line, the alignment of the structural keys and receptacles could not be performed by outside suppliers.

Another disadvantage associated with known structural keys and receptacles is that closure members and door jambs are traditionally manufactured by stamping metal of a constant gage, such that the thickness of the closure member and the door jamb are constant. Consequently, to successfully design the keys and receptacles into a closure member and vehicle body, the area around the keys and receptacles require considerable localized re-enforcing by adding additional metal of a heavier gage, thereby increasing production costs.

While prior art use of the closure member and vehicle body integration technology improves the structural integrity of the overall vehicle body structure, there are disadvantages with the known use of structural keys and mating receptacles. Therefore, there exists a need for improved structural integration of a vehicle closure member and vehicle body that eliminates special alignment and the reinforcing steps while introducing a new metal epoxy technology in the manufacturing process.

SUMMARY OF THE INVENTION

To achieve excellent structural integration of closure members and bodies while overcoming production difficulties, the present invention is directed to vehicle component sub-assemblies that incorporate self-aligning structural key members and mating receptacles. Hinges, latches and other vehicle components are provided with integral structural keys and receptacles such that the keys and receptacles are integrated with the hinges, latches, and strikers, as opposed to the closure member or body.

In accordance with one aspect of the invention, wedge-shaped structural key members and mating receptacles are manufactured as a precision fit integral with and during the same manufacturing operation as a door plate and mating body plate of a door hinge, respectively. Once formed the entire hinge sub-assembly is connected to the vehicle in a conventional manner by bolting the door plate to a closure member, such as a vehicle door, and the attached body plate to a vehicle body. The closure member and body plates are provided with traditional adjustment capability during assembly of the closure member to the vehicle body to insure their proper alignment.

The structural key members and mating receptacles may also be incorporated with other vehicle component sub-assemblies having mating parts such as brackets and door and hood latch sub-assemblies. For example, when the structural keys and receptacles are incorporated into latch and striker sub-assemblies, when a latch is in the correct location for mating engagement with a striker, the structural keys and receptacles formed thereon, will automatically be aligned to a precise fit.

The incorporation of the structural keys and receptacles with the vehicle component sub-assemblies provides important technical and manufacturing benefits over the prior art keys and receptacles. First, hinges, latches and strikers are traditionally manufactured in a heavier gage than the vehicle closure member and corresponding body structure. Therefore, the component sub-assemblies are sufficiently strong for the keys and receptacles cast therein to provided maximum structural integration of the vehicle closure member with the vehicle body without requiring any additional reinforcement.

Further, the manufacture of the structural keys and mating receptacles within the hinges, latches and bracket sub-assemblies is greatly simplified as compared to the prior art practice of manufacturing the structural keys and receptacles as part of the closure member and vehicle body as these component sub-assemblies are simple enough to allow for traditional tolerances that will permit the necessary precision fit of the structural keys to the mating receptacles. Because the hinges, latches and brackets sub-assemblies are usually either cast or forged, it is possible to form the structural keys and receptacles as large as may be necessary while maintaining desirable tight tolerances. Additionally, disadvantages such as warping and springback, that were previously associated with incorporating stamped keys and receptacles into large components, are eliminated, thus reduces dimensional variation.

Vehicle component sub-assemblies having the structural keys and mating receptacles of the present invention may also be easily incorporated to existing vehicle doors without necessitating re-design of the vehicle door or requiring a special alignment step in the manufacturing process by means of additional metal epoxy technology. Therefore, the component sub-assemblies may be manufactured at a separate facility by outside suppliers from the closure member and vehicle body, permitting "just-in-time" incorporation with the vehicle at final vehicle assembly and reducing costs associated with inventory control.

BRIEF DESCRIPTION OF THE DRAWINGS

The features and inventive aspects of the present invention will become more apparent upon reading the following detailed description, claims, and drawings, of which the following is a brief description.

DETAILED DESCRIPTION OF PREFERRED EMBODIMENTS

Figure 1:
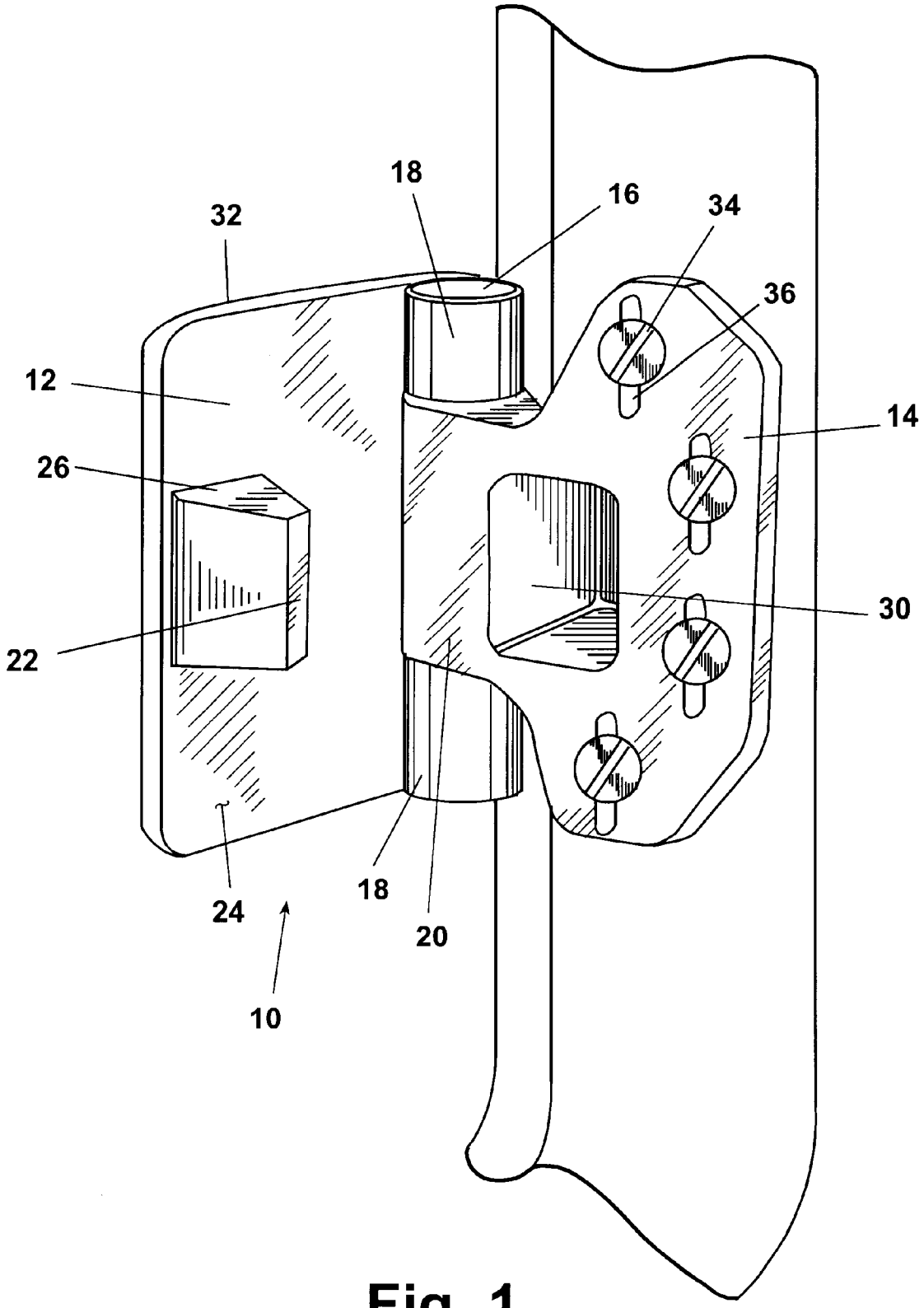
FIG. 1 is a perspective view of a vehicle door hinge sub-assembly incorporating a structural key member and a mating receptacle in accordance with the present invention.

The following figures depict various mating vehicle component sub-assemblies used to integrate a vehicle door to a vehicle body. The door and body integration technology serves to transmit compressive, tensile and shear forces between the vehicle door and the vehicle body with only a minimal amount of modification to an existing vehicle door. Referring to FIG. 1, a first embodiment of the present invention is shown applied to a conventional door hinge sub-assembly 10. Door hinge 10 has a door plate 12 and a mating body plate 14. Door plate 12 is pivotally connected to body plate 14 by a pin 16 that extends through sleeves 18 and 20, of door and body plates 12 and 14, respectively.

In accordance with the invention, the door plate 12 is provided with a structural key member 22 that extends laterally from a front surface 24 of door plate 12. In a preferred embodiment, structural key member 22 is integral with door plate 12 and has a base portion 26 that narrows to an apex 28, such that structural key member 22 is generally wedged-shaped. Body plate 14 is provided with a generally wedge-shaped mating receptacle 30 for complementary engagement with structural key member 22 when the door is closed such that compressive, tensile and torsional forces may be transmitted between the door and the vehicle body to provide a structurally stiffer vehicle. While the wedge shape is preferred, other shapes may be employed, as long as the shape of structural key member 22 is complimentary and appropriately fitted with receptacle 30. Preferably, receptacle 30 is formed integral with body plate 14. To insure proper fit between structural key member 22 and receptacle 30, either structural key member 22, receptacle 30 or both, may optionally be coated with an elastomeric material to provide a tight seal therebetween when the vehicle door is closed.

Figure 2:
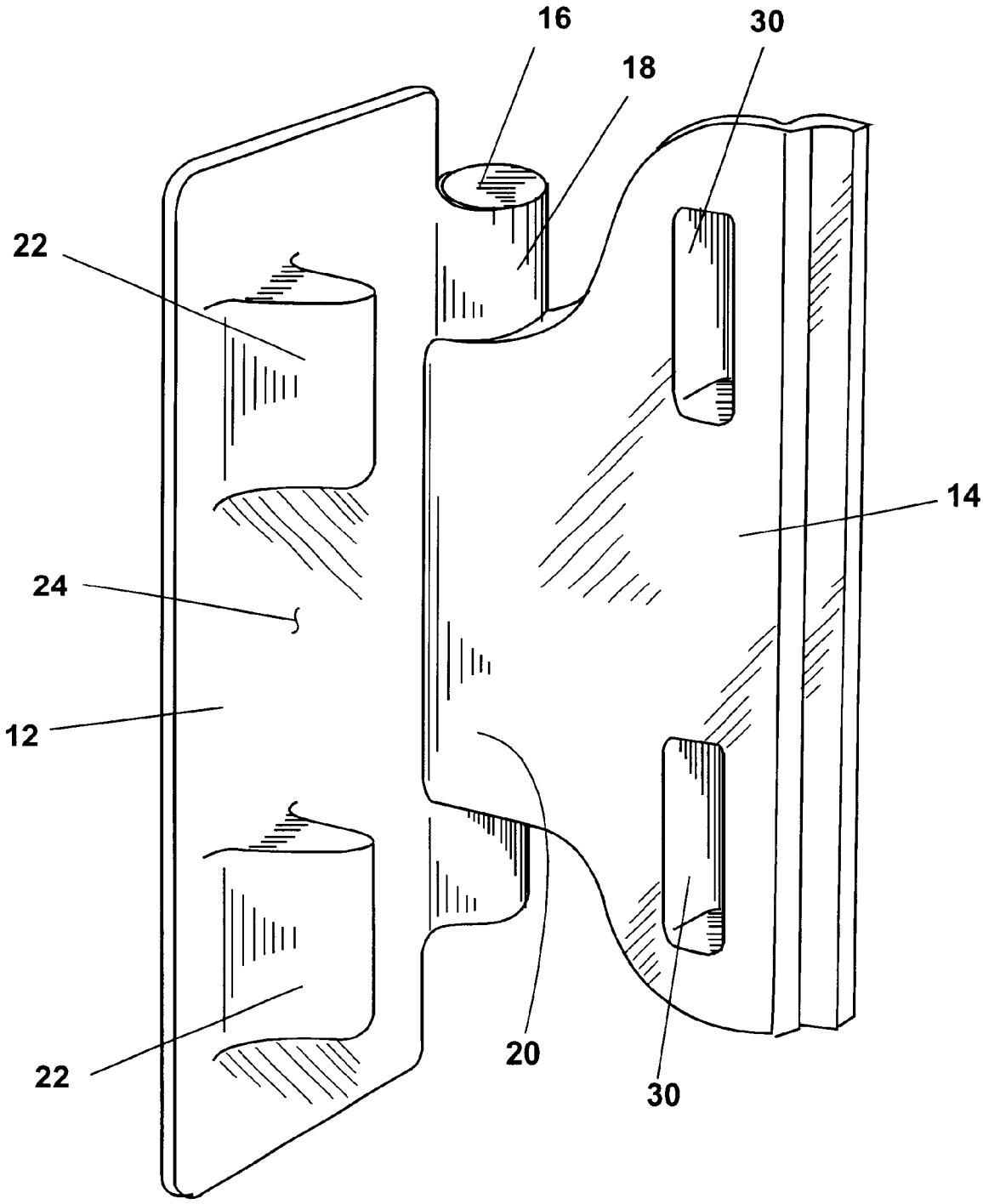
FIGS. 2 and 3 are perspective views of alternative embodiments of the vehicle door hinge sub-assembly of FIG. 1.
Figure 3:
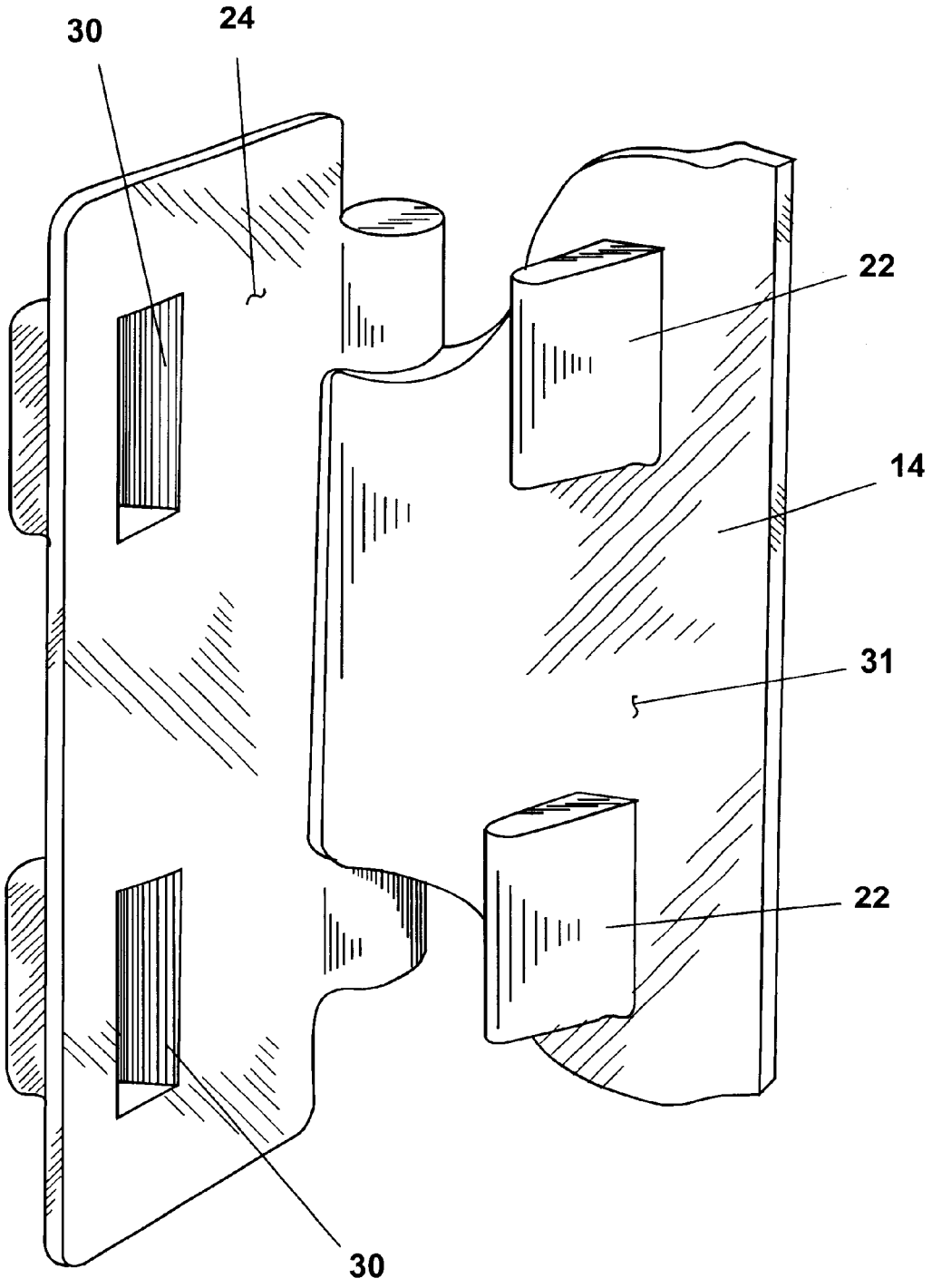

In an alternative embodiment, illustrated in FIG. 2, door plate 12 and body plate 14 are provided with a plurality of structural key members 22 and mating receptacles 30, respectively. Further, the configurations of door plate 12 and body plate 14 may be reversed such that door plate 12 is provided with mating receptacles 30 that extend below front surface 24 and body plate 14 includes structural key members 22 that extend away from a front surface 31 of body plate 14 as seen in FIG. 3. It is also within the scope of the invention that door plate 12 and body plate 14 have both structural key members that engage mating receptacles 30 on the other plate, respectively (not shown).

For structural key member 22 to precisely mate with the receptacle 30 an arc like shape is preferred to follow the mating trajectory of the closing components during opening and closing. FIGS. 2 and 3 demonstrate the curvature of the keys and receptacles to form the proper mating trajectory that facilitates a smooth and precise mating of these components in combination with the overall closure components to which they are attached.

To mount door hinge 10 to a vehicle door, a back surface 32 of door plate 12 is secured to a vehicle door by traditional fasteners or other suitable means. Body plate 14 is preferably secured to a vehicle body by conventional fasteners 34, such as bolts, in a manner so as insure that body plate 14 will be substantially aligned with door plate 12. Because structural key members 22 and mating receptacles 30 are formed on door hinge 10 components 12 and 14, respectively, the alignment of door plate 12 and body plate 14 serve to automatically align structural key members 22 with mating receptacles 30.

The depth of receptacle 30 typically exceeds the thickness of body plate 14. Therefore, it may be necessary to provide a small cut-out on the vehicle body corresponding to the size of receptacle 30. Generally, the cut-out will be slightly larger to permit appropriate positioning of door hinge 10 components 12 and 14 with respect to the vehicle door. Alternatively, structural key members 22 may have a reduced height and mating receptacles 30 a reduced depth such that body plate 14 may be provided with a substantially planar back surface, thereby eliminating the need for a providing a cut-out on the vehicle body.

In accordance with another aspect of the invention, following traditional process alignment of the vehicle door with the vehicle body, body plate 14 may be provided with elongated slots 36 for receiving bolts, whereby body plate 14 would be axially adjustable.

The door hinge 10 may be formed as a sheet metal stamping, such that the structural key member 22 and mating receptacle 30 may be integrally formed in the same operation as the door hinge 10, thereby reducing manufacturing costs. Alternatively, door hinge 10 may be cast or forged with the integral structural key members 22 and mating receptacles 30 formed thereon, thereby making a stronger door hinge 10, and thus a stronger structural connection between structural key members 22 and mating receptacles 30.

Other advantages of providing door hinge 10 with structural key member 22 and mating receptacle 30 include manufacturing of door hinge 10 at a separate facility, permitting "just-in-time" incorporation with the vehicle door at the vehicle assembly line. Thus inventory control costs and costs associated with storage may be reduced. Further, as structural keys 22 and receptacles 30 are provided on door plate 12 and body plate 14, respectively, there is no need to re-design the vehicle door or alter the body structure of the vehicle body to insure the proper strength reinforcement of structural key members 22 and mating receptacles 30. Thus, manufacturing costs are reduced and incorporation of structural key members 22 and mating receptacles 30 on existing vehicle doors may be accomplished easily.

Figure 4:
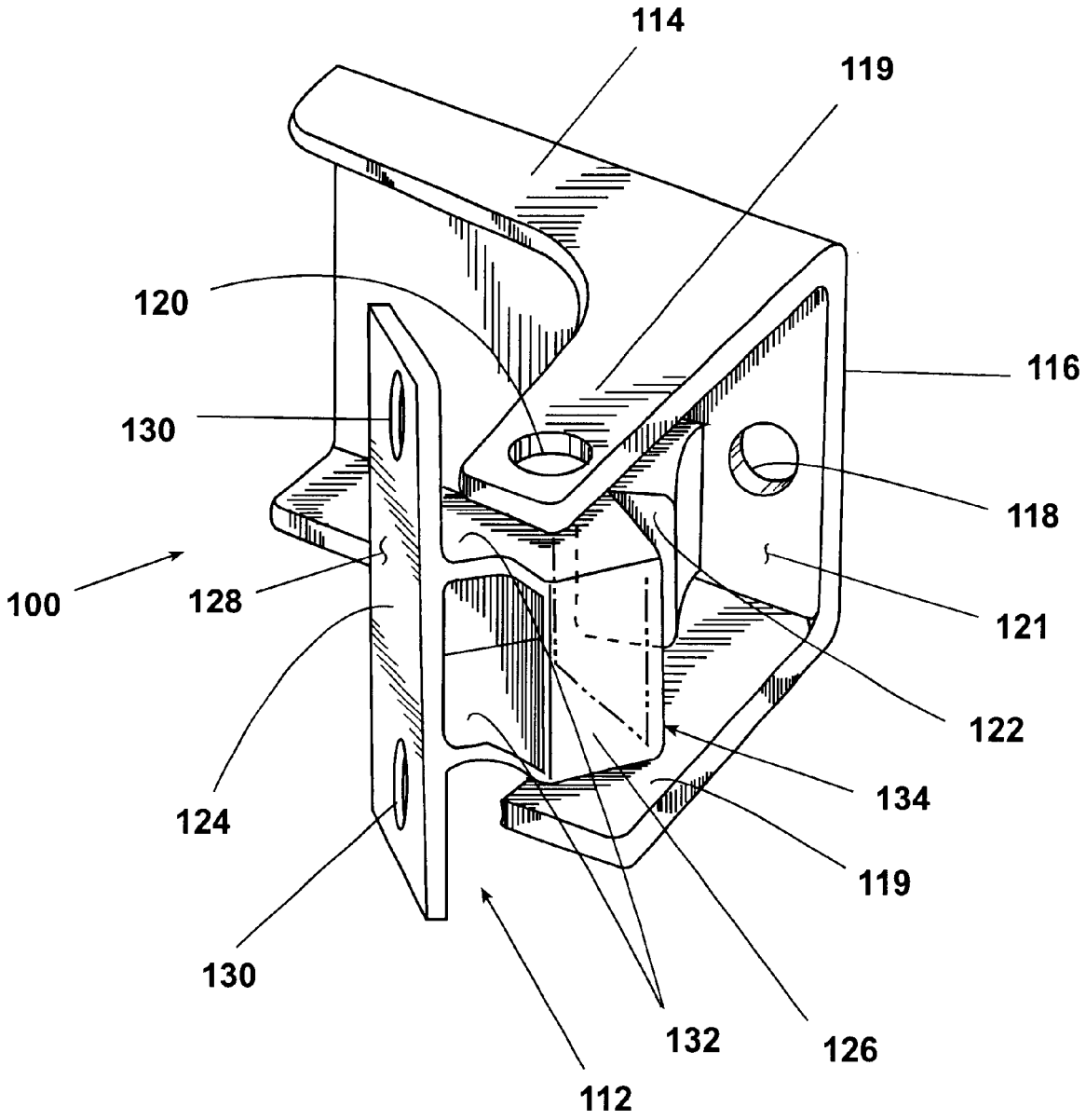
FIG. 4 is a perspective view of an alternative vehicle door hinge sub-assembly incorporating a structural key member and a mating receptacle in accordance with the present invention.

FIG. 4 depicts an alternative door hinge 100 having a door plate 112 and a body plate 114 pivotally connected together once properly aligned. Body plate 114 is L-shaped and includes a substantially planar mounting surface 116 that is configured to engage a portion of a vehicle body. Mounting surface 116 is provided with conventional oversize apertures 118 for receiving fasteners, such as bolts for fixedly securing and adjusting body plate 114 to the vehicle body. Alternatively, body plate 114 may be welded to the vehicle body or attached by other suitable means. Aligned legs 119 extend away from mounting surface 116 and include apertures 120, to be explained in further detail below.

In accordance with the present invention, a front surface 121 of body plate 114 is provided with a structural key member 122 extending therefrom. Structural key member 122 is slightly angled and curved relative to body plate 114, to be explained below, and has a rectangular cross-section. Other suitable shapes may be employed for structural key member 122.

Door plate 112 includes a mounting portion 124 and a bracket portion 126. Mounting portion 124 has a substantially planar mounting surface 128 that is configured to engage a portion of a vehicle door. Apertures 130 are provided in mounting portion 124 for receiving fasteners, such as bolts, to adjust and fixedly secure door plate 112 to a vehicle door. Bracket portion 126 is connected to mounting portion 124 by webs 132. Bracket portion 126 includes an axially extending aperture (not shown) that corresponds an apertures 120 on body plate 114 for receiving a pin (not shown) in a conventional manner to pivotally connect door plate 112 and body plate 114.

In accordance with the invention, bracket portion 126 further includes a receptacle 134 formed therein that has a size and shape that corresponds to the size and shape of structural key member 122. Thus, when the vehicle door is closed, structural key member 122 engages receptacle 134, similar to that of door hinge 10, such that compressive, tensile and torsional forces may be transmitted between the door and the vehicle body, thereby providing a structurally stronger vehicle.

Door hinge 100 may be directly mounted to a vehicle without requiring any additional modifications to the vehicle. Unlike door hinge 10, there is no need for the vehicle door or body to be provided with an additional cut-out as receptacle 134 is formed in the bracket portion 126. Thus, incorporation of door hinge 100 as a "just-in-time" component to an existing vehicle door and body may be accomplished cost-efficiently with a minimum of production steps. Further, in accordance with the present invention, pre-alignment of structural key member 122 and mating receptacle 134 during manufacturing is not disturbed by virtue of the alignment of door plate 112 and body plate 114.

Figure 5:
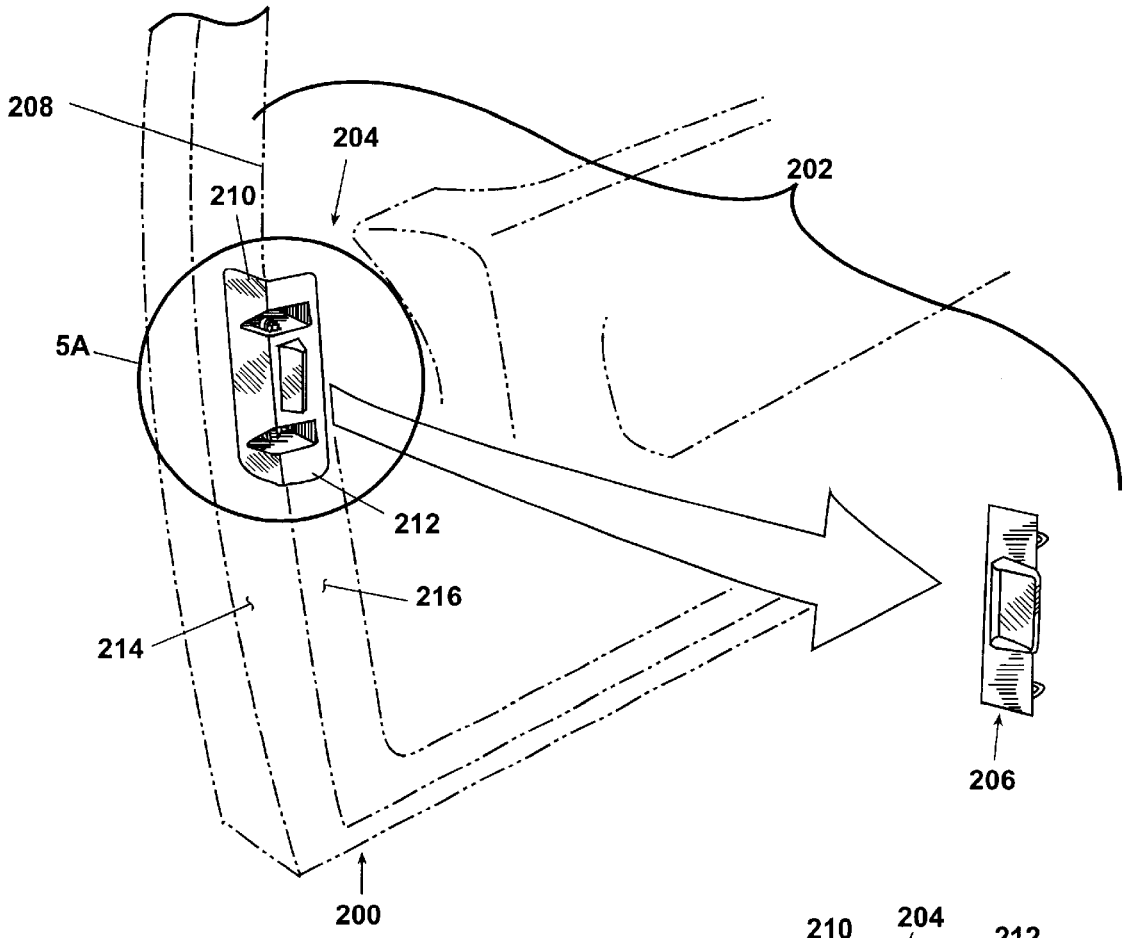
FIGS. 5 and 5A are perspective views of a door latch sub-assembly incorporating a structural key member that engages a mating receptacle in accordance with the present invention.
Figure 5A:
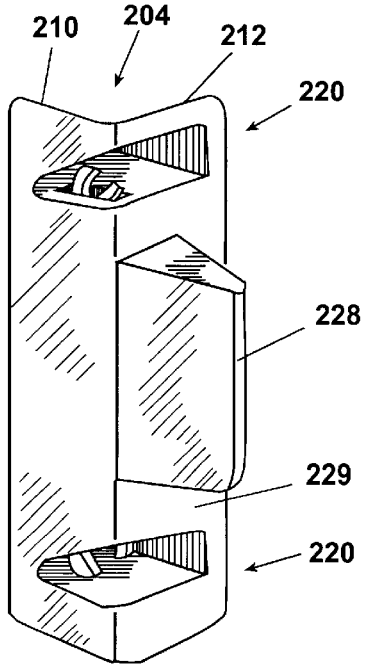

While use of the structural key members 22, 122 and mating receptacles 30, 134 have thus far been described for use with vehicle door hinges, the inventive technology may also be utilized with other vehicle component parts, as well. Referring to FIG. 5, in an alternative embodiment a vehicle door 200 is shown having a door latch sub-assembly 202 that includes a door latch plate 204 and a mating door striker plate 206. Door latch plate 204, as more clearly seen in FIG. 5A, is shown mounted on a trailing edge 208 of vehicle door 200. Door latch plate 204 has an L-shaped cross-section with a first leg 210 and a second leg 212. First leg 212 is mounted to an outside surface 214 of trailing edge 208 and second leg 212 is mounted to an inside surface 216 of trailing edge 212. Door latch plate 204 may be mounted by welding or conventional fasteners, such as bolts. Door latch plate 204 carries at least one conventional door latch 220. In accordance with the invention, door latch plate 204 further includes at least one structural key member 228 formed thereon extending laterally from a front surface 229 of second leg 212.

Figure 6:
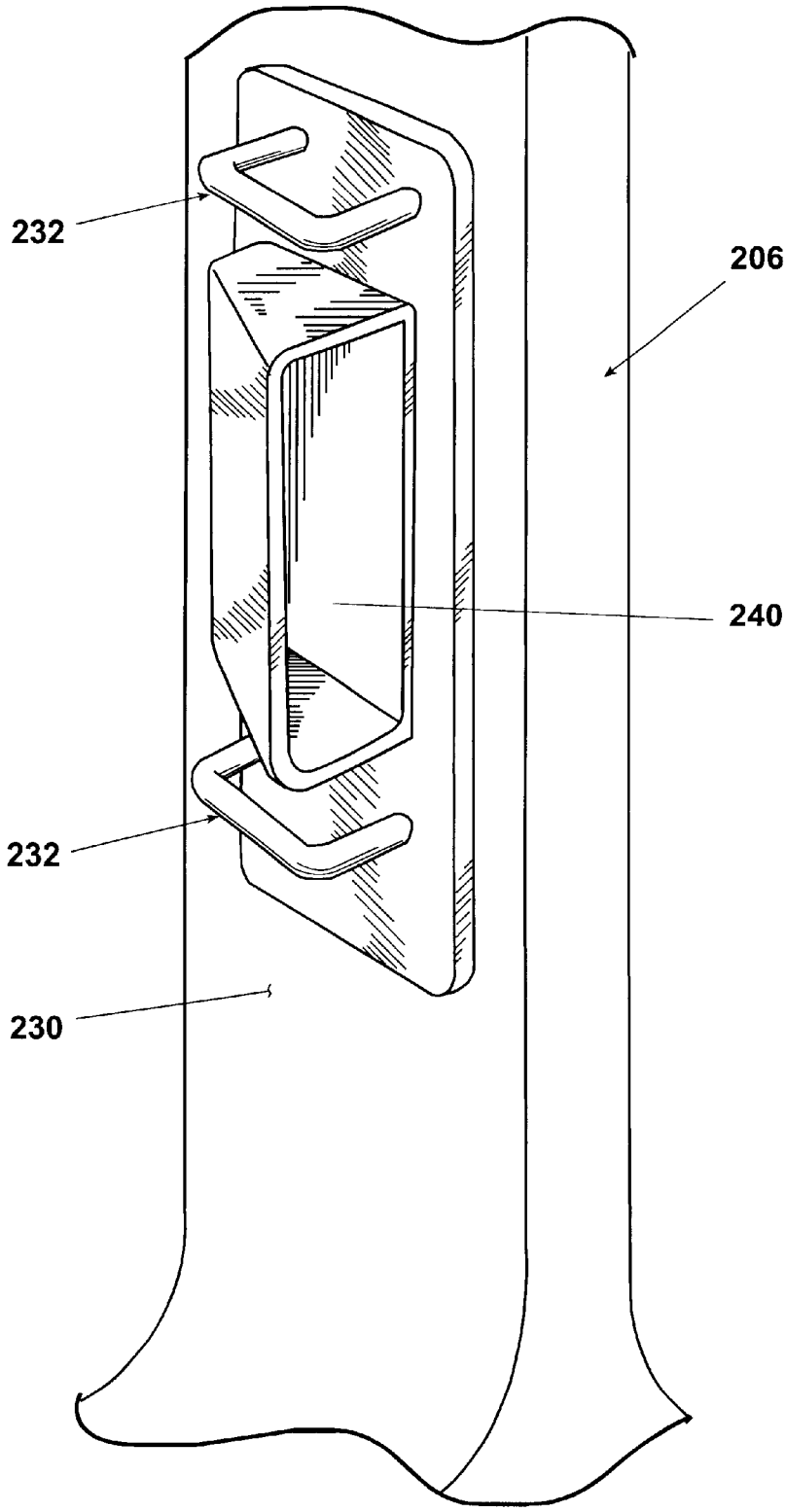
FIG. 6 is a perspective view of a door striker plate having a receptacle formed therein.

Door striker plate 206, as more clearly seen in FIG. 6, is mounted along an inside surface 230 of a door jamb (not shown) of a vehicle body by welding or conventional fasteners so as to be aligned with door latch plate 204. Door striker plate 206, includes a least one bar 232 that is captured by door latch 220 in a conventional manner. In accordance with the present invention, door striker plate 206 further includes a receptacle 240 that has a size and shape that corresponds to structural key member 228.

Because door latch plate 204 and door striker plate 206 are pre-aligned during manufacture and properly mated, using traditional door adjustment and assembly techniques, when vehicle door 200 is closed, bars 232 extend into and are captured by door latch 220. Simultaneously, structural key member 228 extends into mating receptacle 240, thereby structurally integrating the door and the vehicle body via the door latch sub-assembly 202. The incorporation of structural key member 228 and mating receptacle 240 with door latch assembly 202 further insure that door latch 220 will remain secured to bar 232 in the event of a collision.

Figure 7:
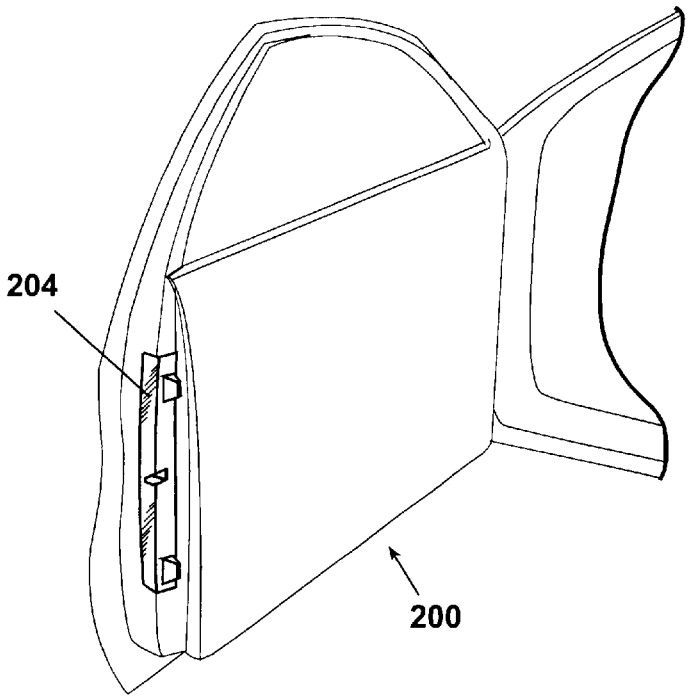
FIGS. 7–11 are perspective views of alternative embodiments of a door latch plate in accordance with the present invention.
Figure 7A:
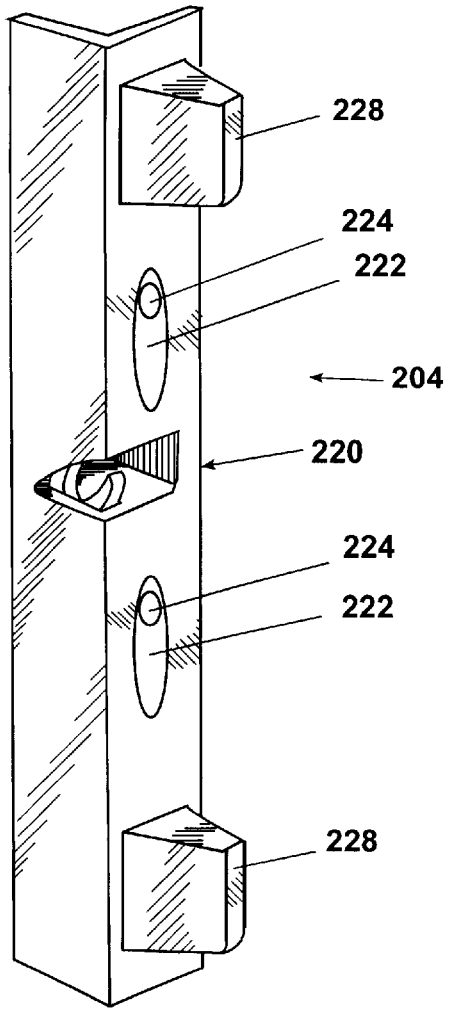

While only one structural key member 228 has been shown formed on door latch plate 204 and one mating receptacle 240 has been shown formed in door striker plate 206, alternatively, door latch plate 204 may have multiple structural key members 228 formed thereon, as seen in FIGS. 7 and 7A. Further, door latch plate 204 may be of varying lengths to properly accommodate a predetermined number of structural key members 228 formed thereon. Similarly, door striker plate 206 may be provided with multiple receptacles 240 corresponding to the number of structural key members 228.

Preferably, either door latch plate 204 or door striker plate 206 is provided with a traditional adjustability feature, similar to that described with respect to door hinge 10. Referring to FIG. 7A, front surface of door latch plate 204 is shown having bolt slots 222 formed therein for receiving a bolt 224, such that door latch plate 204 may be axially slidable to insure proper alignment of door latch 220 with the striker.

Figure 8:
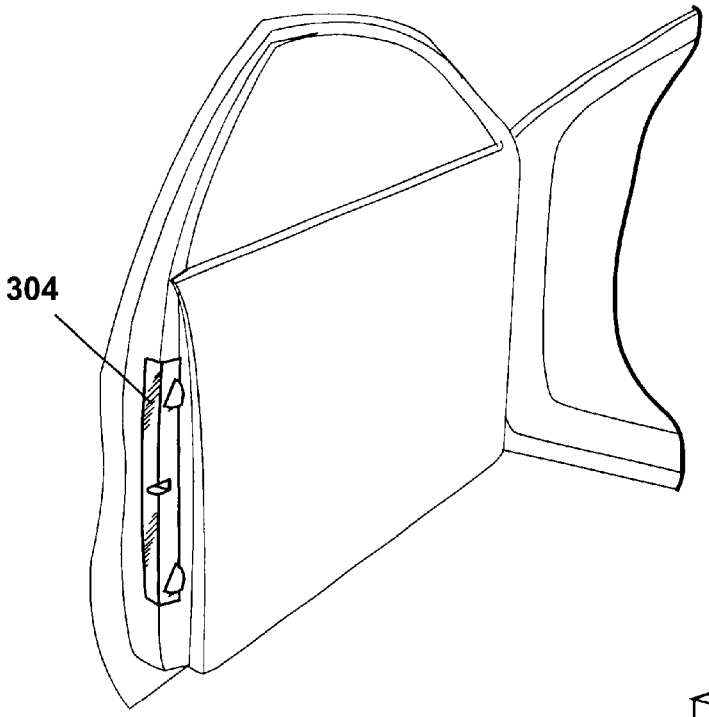
Figure 8A:
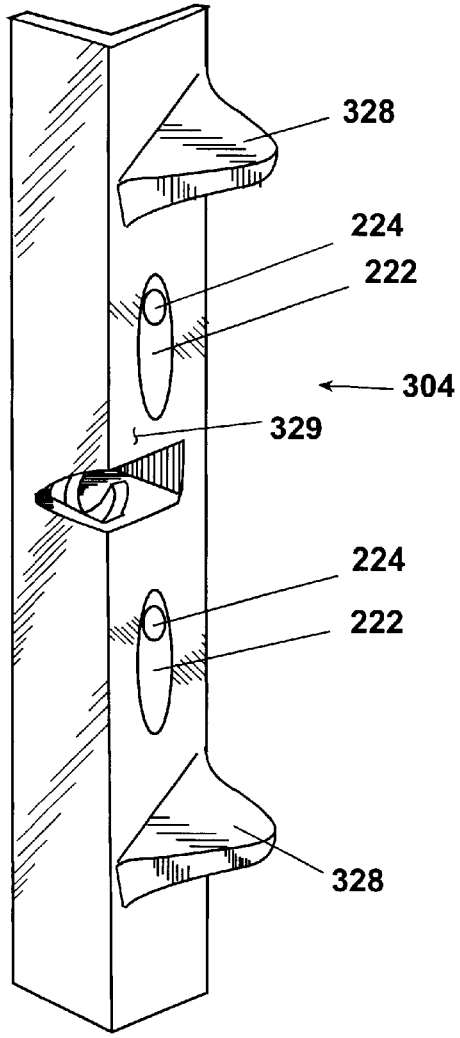
Figure 9:
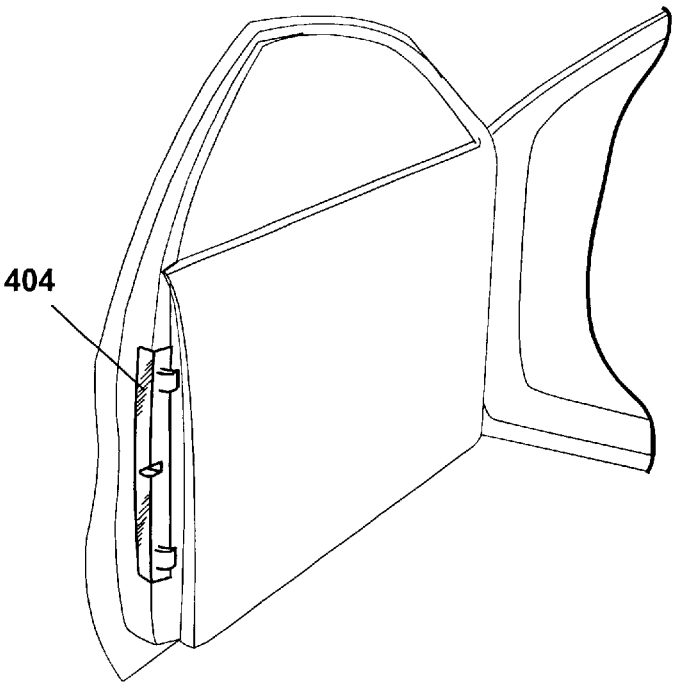
Figure 9A:
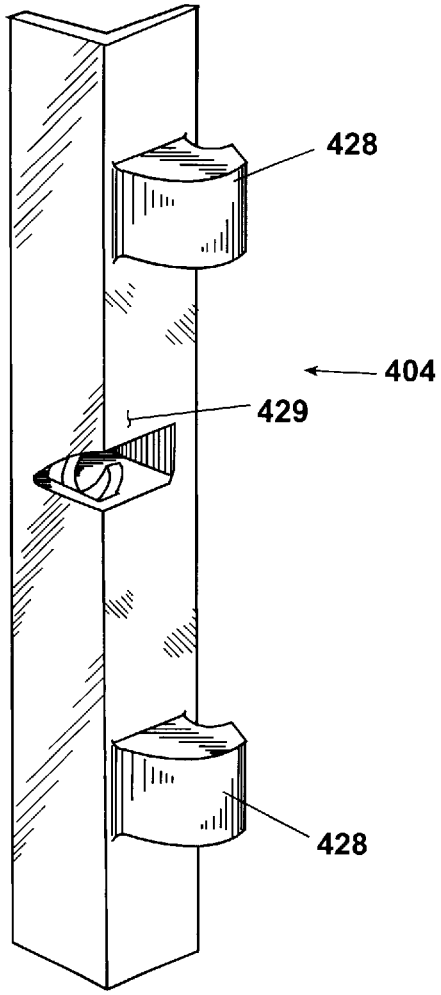

Referring to FIGS. 8–9A, structural key members 328 may optionally have alternative orientations and shapes. For example, FIG. 8 shows structural key members 328 formed so as to be laterally extending from front surface 329 of door latch plate 304 at a predetermined angle. Corresponding receptacles (not shown) would similarly angled in the door striker plate (not shown) such that structural key members 328 would interlock with the angled receptacles. FIG. 9 shows structural key members 428 formed in door latch plate 404, wherein structural key members 428 are formed so as to be curved with a predetermined radius. Corresponding receptacles (not shown) would be formed so as to be curved such that structural key members 428 will interlock with the receptacles when door 400 is closed, thereby integrating the vehicle door with the vehicle body via the door latch assembly as described above.

Figure 10:
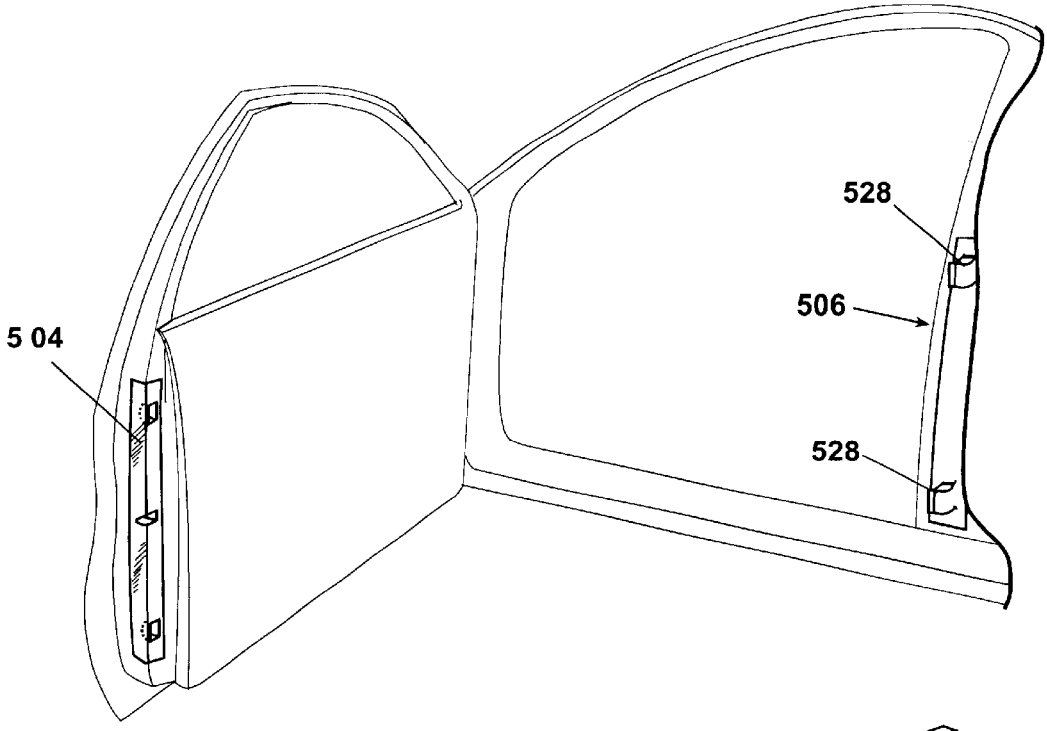
Figure 10A:
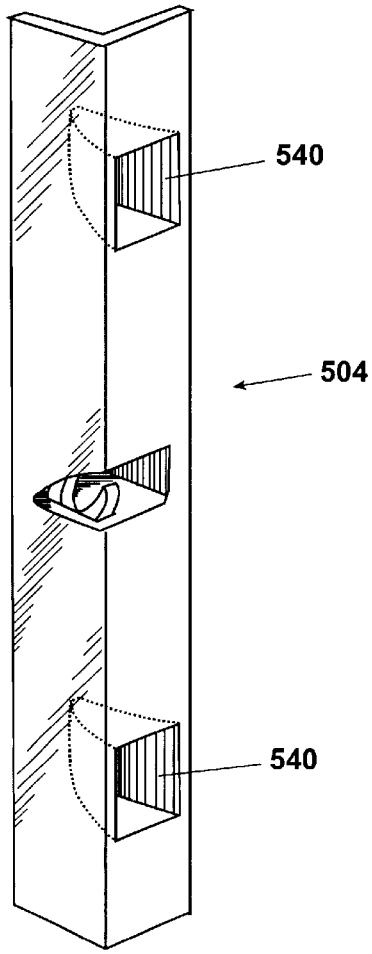

Further, structural key member 228 and receptacles 240 may be interchanged. For example, referring to FIGS. 10 and 10A, door latch plate 504 may be provided with receptacles 540 and door striker plate 506 provided with structural key members 528. Alternatively, door latch plate 504 and door striker plate 506 may both be provided with a structural key member and a mating receptacle (not shown).

Figure 11:
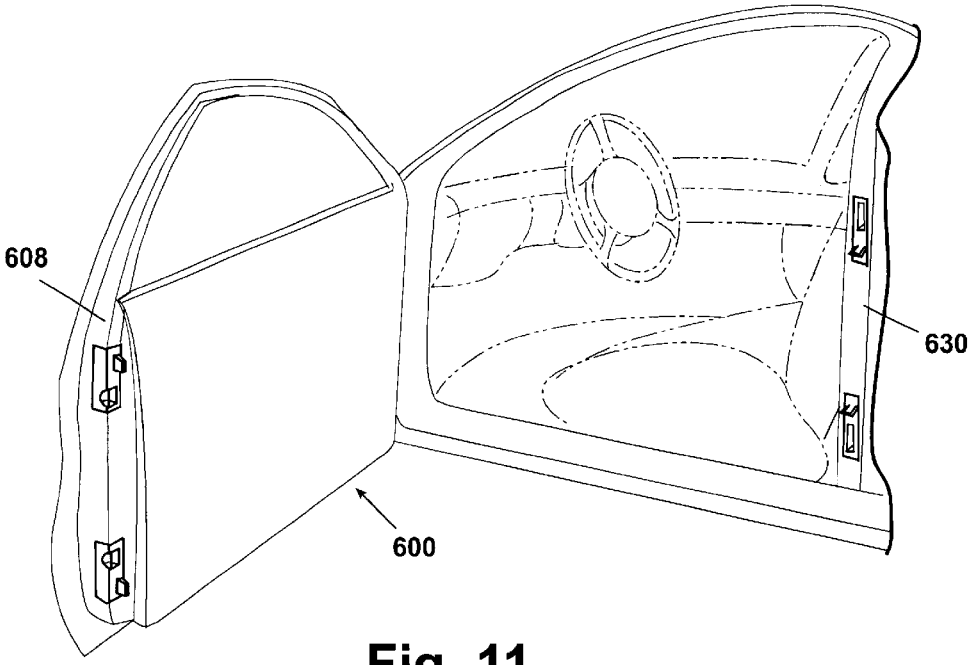
Figure 11A:
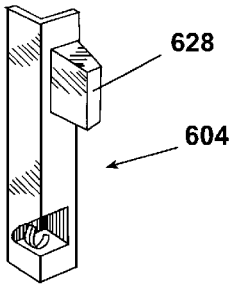
Figure 11C:
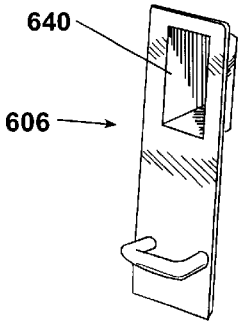
Figure 11B:
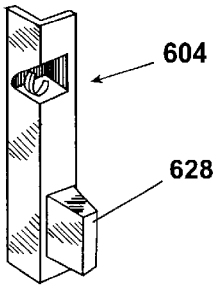
Figure 11D:
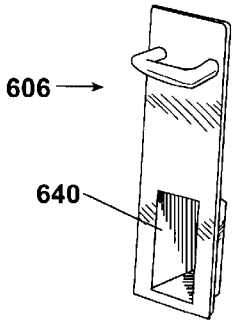

Referring to FIGS. 11–11D, in another alternative embodiment, multiple door latch plates 604, each incorporating at least one structural key member 628 and corresponding mating door striker plates 606 each incorporating at least one mating receptacle 640 therein are shown mounted on leading edge 608 of vehicle door 600 and door jam 630 of a vehicle body, respectively. In accordance with the present invention, once door latch plate 604 is properly positioned on door 600 so as to align with mating striker plate 606; structural key members 628 are automatically aligned with mating receptacles 640.

Figure 12:
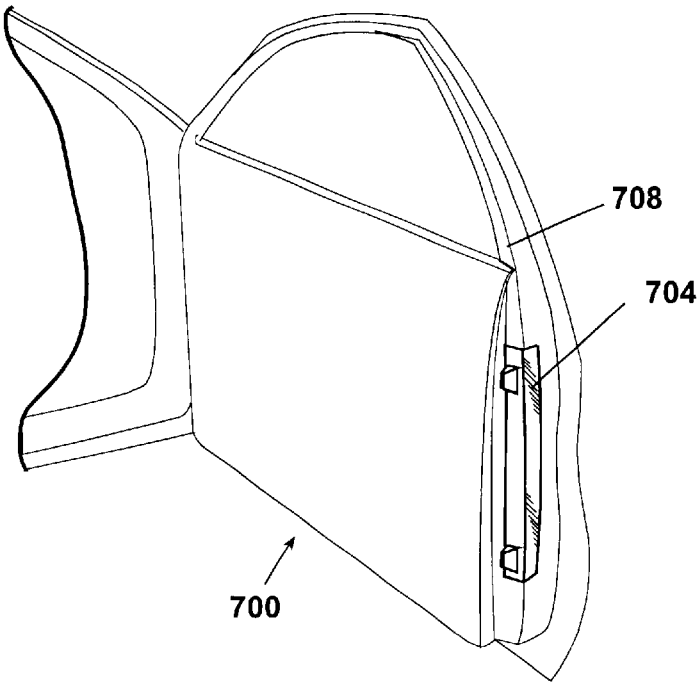
FIGS. 12 and 12A are perspective views of a bracket sub-assembly incorporating structural key members that are engageable with mating receptacles in accordance with the present invention.
Figure 12A:
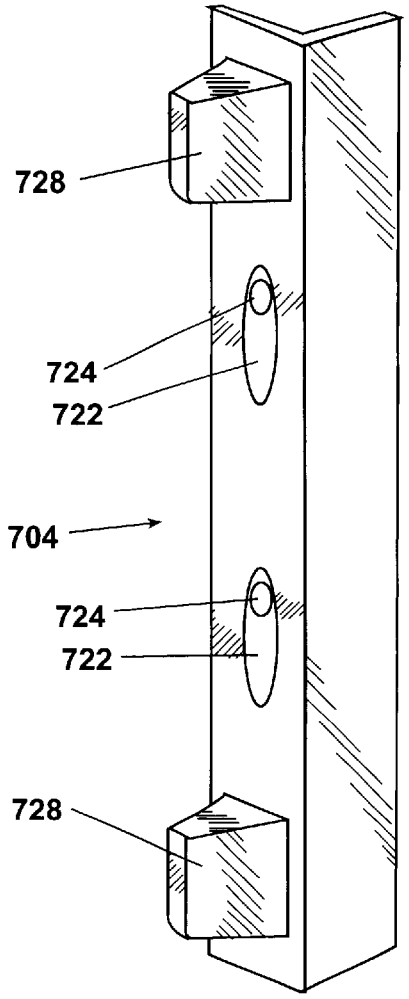

Referring to FIGS. 12 and 12A, structural key members 728 may alternatively be provided on brackets 704 that are mounted on a trailing edge 708 of a vehicle door 700. The use of brackets 704 is useful as an after-market product when it is desired to integrate an existing vehicle door 700 with a vehicle body. Brackets 704 may be mounted to vehicle door 700 by welding or conventional fasteners. Preferably, brackets 704 are provided with adjustment slots similar to slots 36 described in connection with door hinge such that the positioning of bracket 704 is axially adjustable to mate up with a corresponding mating bracket (not shown) mounted on the vehicle body.

Similar to door latch plate 204 in FIG. 5, bracket 704 preferably has an L-shaped cross section that engages both surfaces adjacent trailing edge 708 of vehicle door 700. Integral with a first leg 712 is at least one structural key member 728. Structural key members 728 are shown as being generally wedge-shaped, although other suitable shapes are within the scope of the invention, as discussed above. A second corresponding mating bracket (not shown) is mounted to a door jam of the vehicle body so as to be in substantial alignment with bracket 704 in a similar fashion as door striker plate 206 in FIG. 5, wherein the second bracket includes at least one receptacle that corresponds in size and shape to structural key member 728. Thus, when vehicle door 700 is closed, structural key members 704 interlock with the corresponding receptacles to structurally integrate vehicle door 700 and the vehicle body in accordance with the present invention.

Figure 13:
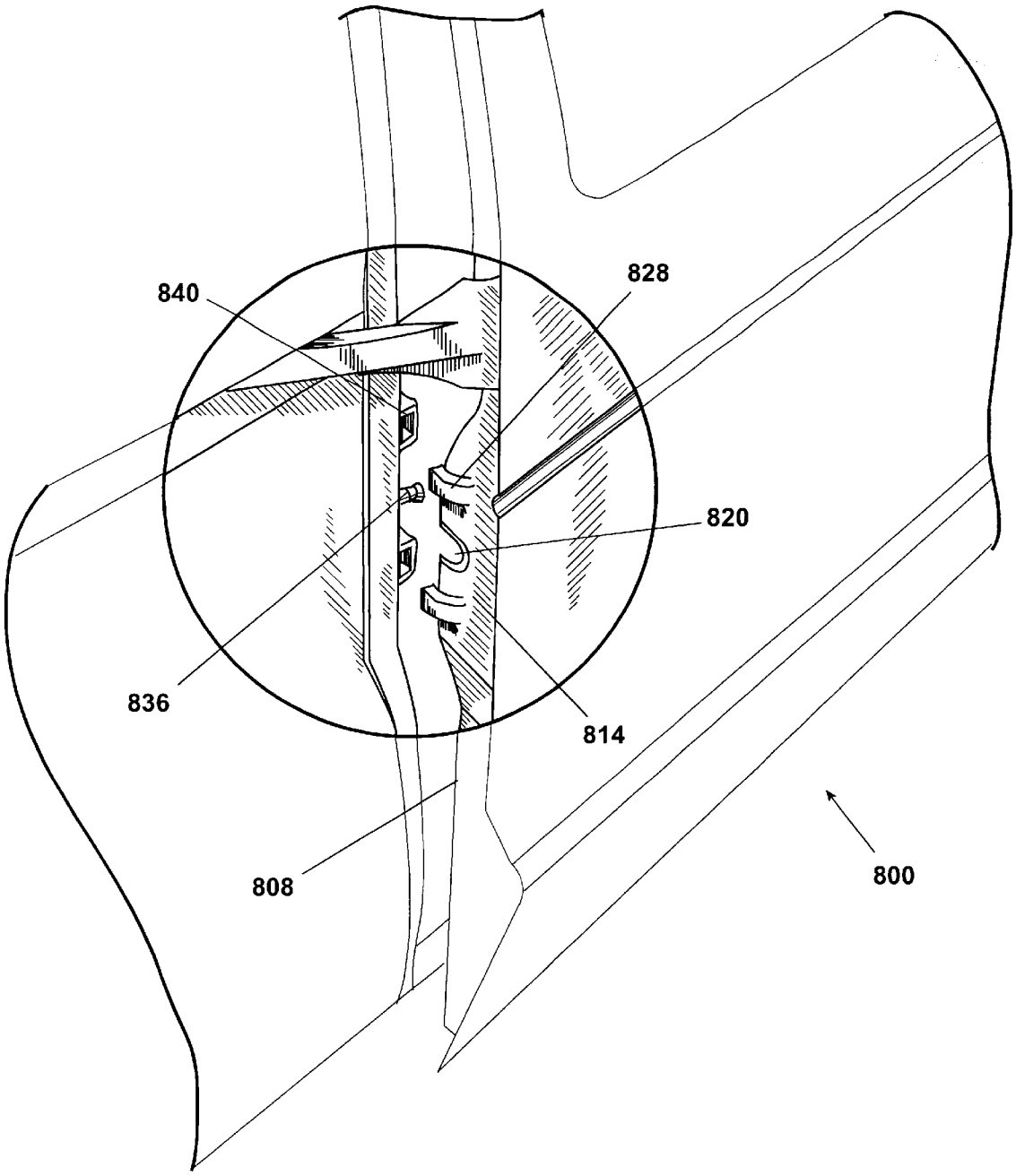
FIGS. 13–14 are perspective views of alternative embodiments of a sliding vehicle door utilizing the structural key members and mating receptacles of the present invention.
Figure 14:
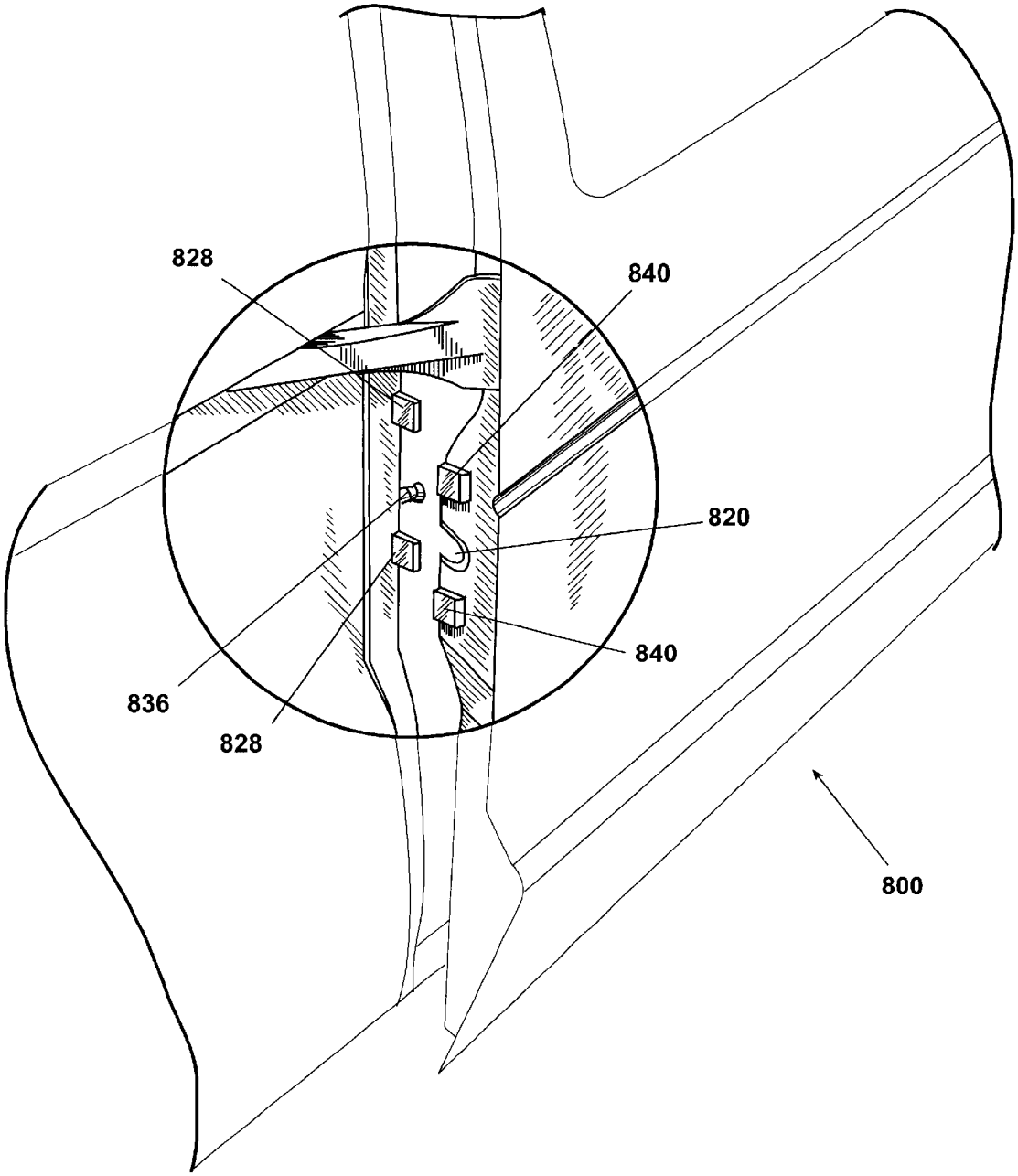

Referring to FIGS. 13 and 14, the present invention may also be incorporated with sliding vehicle doors 800. In FIG. 13, vehicle door 800 is provided with a door latch plate 804 mounted along an inside trailing edge 808 and a door striker plate (not shown) mounted on the door jam of the vehicle body so as to be substantially aligned with door latch plate 804. Door latch plate 804 carries a door latch 820 that captures an engagement member 836 of the door striker plate in a conventional manner when vehicle door 800 is closed. In accordance with the present invention, door latch plate 804 further includes at least one structural key member 828 formed thereon. Structural key members 828 are engagable with mating receptacles 840 formed on the door striker plate when vehicle door 800 is closed. Due to the path of vehicle door 800, structural key members 828 are curved to insure proper engagement with receptacles 840. Alternatively, referring to FIG. 14, the positions of structural key members 828 may be reversed such that structural key members 828 are connected to the vehicle body and the mating receptacles 840 are carried by vehicle door 800. Further, structural key members 828 and receptacles 840 may optionally be integrally formed with vehicle door 800 and the door jam, respectively.

Figure 15:
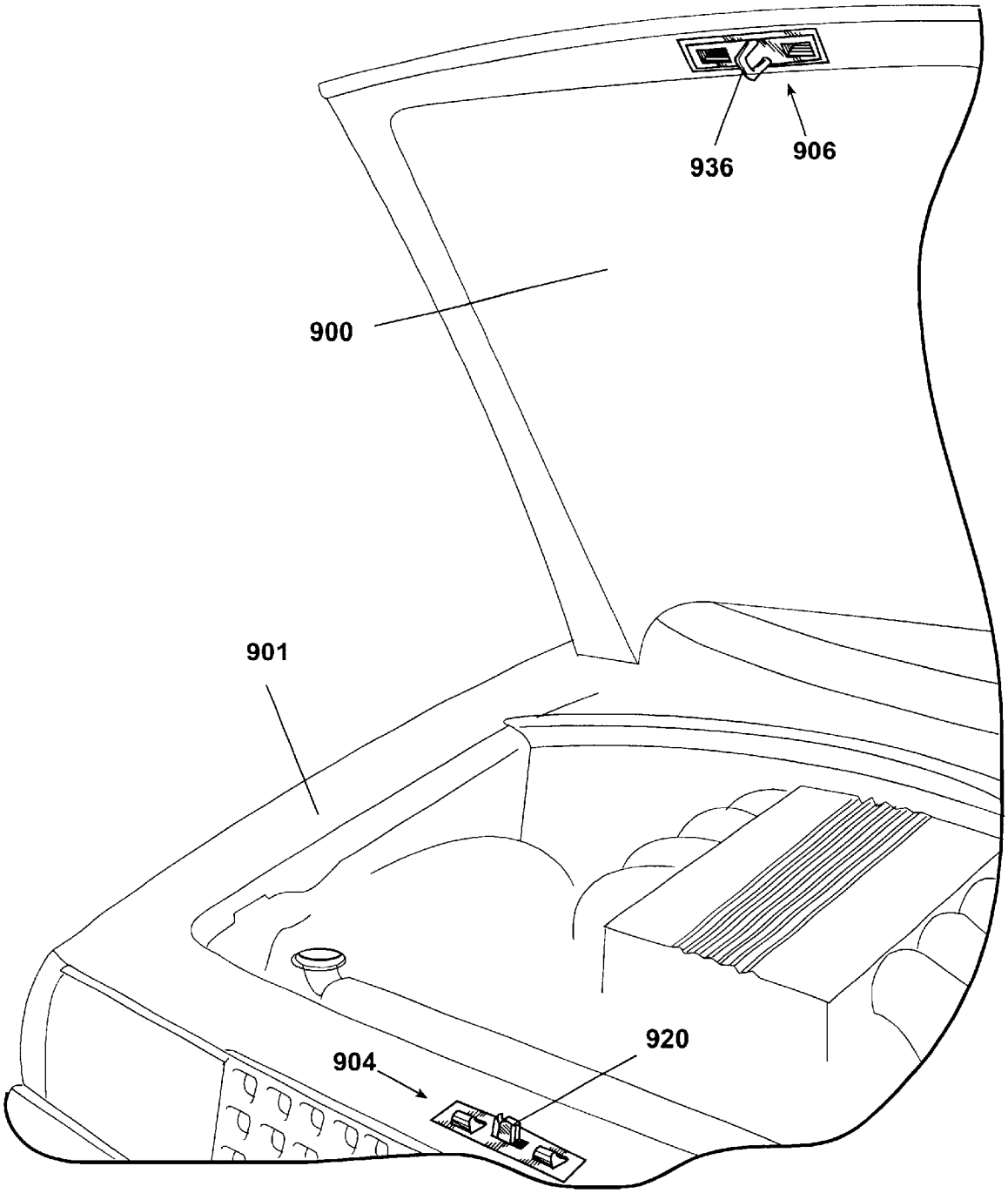
FIG. 15 is a perspective view of a vehicle hood latch sub-assembly incorporating the structural keys and mating receptacles in accordance with the present invention.
Figure 16:
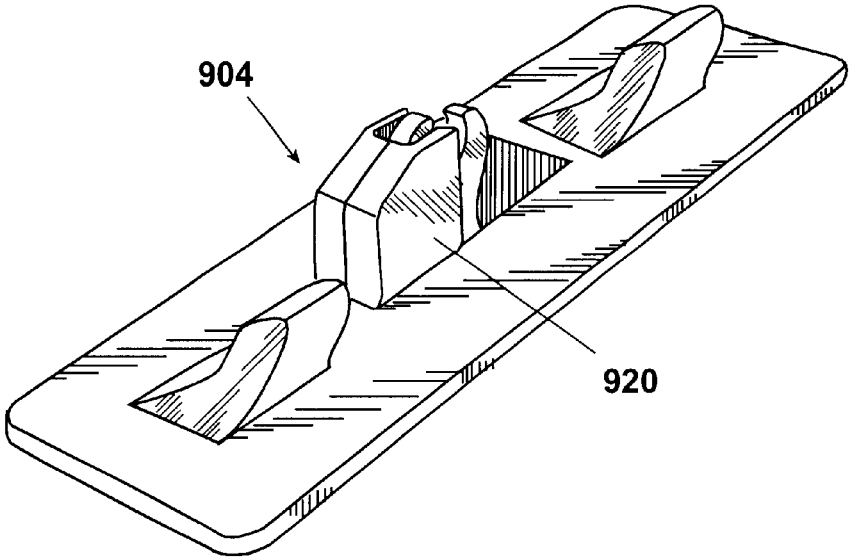
FIGS. 16 and 17 are perspective views of alternative embodiments of a hood or trunk latch plate.
Figure 17:
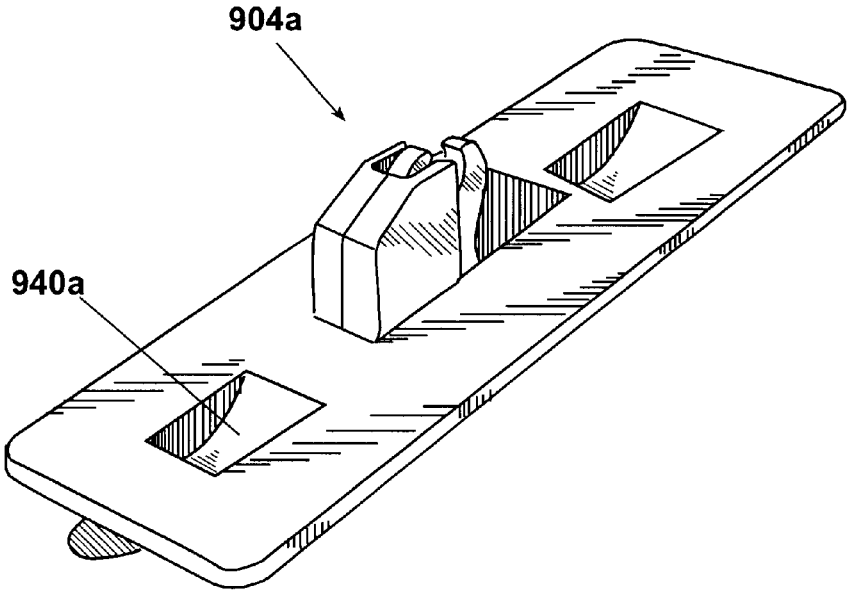

Referring to FIGS. 15–17, in another alternative embodiment, structural key members 928 and mating receptacles 940 are shown incorporated with hood latch assemblies 902 for a vehicle hood 900. Referring to FIG. 15, vehicle hood 900 is provided with a hood striker plate 906 mounted thereon (as best seen in FIG. 16), having an engaging member 936 that generally corresponds to door striker plate 206 and engaging member 236 in FIG. 5. The vehicle body 901 is provided with a hood latch plate 904 mounted thereon that aligns and engages with hood striker plate 906. Hood latch plate has a latch 920 that generally corresponds to door latch plate 204 and door latch 220 in FIG. 5.

In accordance with the present invention, hood latch plate 904 further includes at least one structural key member 928 formed and pre-aligned during manufacture to engage at least one mating receptacle 940 formed in hood striker plate

906. Because hood latch plate 904 is positioned in traditional manner during assembly so as to align with hood striker plate 906, structural key member 928 and receptacle 940 are automatically aligned in accordance with the present invention.

When vehicle hood 900 is closed and hood latch 920 captures bar 932 in a conventional manner and structural key member 928 engages with mating receptacle 940, thereby structurally integrating vehicle hood 900 with vehicle body 901. Referring to FIG. 17, hood latch plate 904 may alternatively be formed with receptacles 940*a* that engage structural key members formed in the hood striker plate. Additionally, the structural key members may be formed with a plurality of different shapes, sizes and orientations, provided that receptacles 940*a* have a corresponding shape, size and orientation.

Additional embodiments of the present invention include incorporating structural key members and mating receptacles with sunroofs, trunks, etc.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed:

1. A vehicle component sub-assembly having self-aligning structural members, comprising:

an L-shaped body hinge plate having engaging legs and a base portion with a substantially planar first surface fixedly mounted on a portion of a vehicle body having an opening, and a substantially planar second surface; and a closure member hinge plate having a bracket portion and a mounting portion, said mounting portion having a substantially planar surface fixedly connected to a closure member which selectively covers and uncovers said opening in said vehicle body;

wherein said bracket portion is positioned between and pivotally connected to engaging legs of said body hinge plate so as to be substantially aligned with said door hinge plate such that said body and closure member hinge plates are matingly interlocked together for pivotal movement to hingedly connect said closure member to said vehicle body;

said substantially planar second surface of said body hinge plate further having an integrally formed structural key member thereon, and said closure member hinge plate having an integrally formed mating receptacle formed thereon;

wherein said structural key member extends laterally from a front surface of said body hinge plate;

wherein said mating receptacle extends inwardly from a front surface of said closure member hinge plate, said mating receptacle further including a plurality of side walls for surrounding and receiving said structural key member such that said structural key member fits tightly within said mating receptacle when said structural key member is engaged with said mating receptacle; and wherein alignment of said body and closure member hinge plates during assembly do not disturb pre-alignment of said structural key member with said mating receptacle such that when said closure member hinge plate is pivoted toward said body hinge plate when said closure member covers said opening, said structural key member and said mating receptacle structurally connect and integrate said closure member to said vehicle to permit compressive, tensile and torsional forces between said closure member and said vehicle body.

2. The vehicle component sub-assembly of claim 1, wherein said at least one of said structural key members and mating receptacles are coated with an elastomeric material.

* * * * *